United States Patent [19]

Jaenke et al.

[11] Patent Number: 5,073,121

[45] Date of Patent: Dec. 17, 1991

[54] LOW IMPEDANCE CONNECTOR

[75] Inventors: Paul E. Jaenke, Arnold, Md.; Ronald E. Armiger, Millersville, Pa.

[73] Assignee: Westinghouse Electric Corp, Pittsburgh, Pa.

[21] Appl. No.: 618,867

[22] Filed: Nov. 28, 1990

[51] Int. Cl.[5] ..... H01R 4/30; H01R 4/26

[52] U.S. Cl. ..... 439/92; 439/387; 439/801

[58] Field of Search ..... 439/86-92, 439/784, 387, 390, 801; 174/94 R, 94 S; 403/13, 14, 282, 335, 337

[56] References Cited

U.S. PATENT DOCUMENTS

| | | | |
|---|---|---|---|
| 2,820,084 | 1/1958 | Shaw | 174/94 S |
| 3,157,735 | 11/1964 | Stroup et al. | 439/387 |
| 3,344,316 | 9/1967 | Stelmak | 439/387 |

*Primary Examiner*—Gary F. Paumen

*Attorney, Agent, or Firm*—D. Scron

[57] ABSTRACT

An electrical ground connection having two members which are clamped together with each member having a cavity which faces the cavity of the other member when assembled. In one embodiment the cavities include a series of sharp projections and a disk of relatively soft metal such as copper is inserted into one of the cavities and when the members are brought together, the projections from both members penetrate into the disk to form a low impedance electrical connection which may be disassembled and reassembled with relative ease. An O-ring seal and a waterproof gel within the cavities may be utilized for underwater applications of the connector. In another embodiment a single projection in each cavity is used, in conjunction with a disk having a central aperture which fits over the projections, with edge portions of the projections digging into the central wall surface of the apertured disk.

13 Claims, 5 Drawing Sheets

LOW IMPEDANCE CONNECTOR

BACKGROUND OF THE INVENTION

1. Field of the Invention

The invention in general relates to electrical connectors, and in particular to a low impedance connector which may be used as a low impedance ground in harsh atmospheric environments as well as in the underwater field.

2. Background Information

In order to meet repairability, maintainability and minimum downtime requirements, many complex electrical systems include components of a modular nature to facilitate removal and replacement. Very often, the various components of the system are carried by a metallic support structure and to reduce or eliminate electrical noise, it is desired that the various modules of the system have a common system ground such as the metal support structure itself.

Various types of grounding schemes are utilized including the mounting of metallic housings directly to the metallic support structure to establish a bare metal-to-metal contact. Depending upon the environment in which the equipment is used, such grounding arrangement may prove less than satisfactory, particularly in an under water environment, and further, where dissimilar metals exposed to the sea water are used.

Other grounding arrangements include the use of jacketed ground cables connected to grounding pins on two units to be grounded and for the under water environment, an oil compensated barrier in the form of an oil-filled tube is provided around the grounding strip. Such arrangements provide satisfactory grounding, however, they are undesirable for systems which require component removal for repair and/or maintenance.

The present invention provides for a low impedance connection which may be used as an electrical grounding arrangement in which the making and breaking of the electrical ground connection is relatively simple, quick and an extremely low impedance path to ground is provided.

The low impedance electrical connector includes first and second electrically conducting members, at least one of which is for electrical connections to electrical equipment. A clamping means is provided for releasably maintaining the members in intimate contact when in use and each member includes a cavity which faces the cavity of the other member when the members are clamped together, with the cavities forming a hollow chamber. Each of the cavities includes at least one protuberance which project into the chamber and a grounding disk is provided for placement within the chamber and is of a softer metal than both the members and protuberances. The arrangement is such that when the grounding disk is inserted into the chamber and the members are clamped together, the surface of the grounding disk will be deformed by the protuberances digging into it, thereby making intimate electrical contact with and between the members. When utilized in harsh environments, a sealing means is provided which surrounds the chamber to exclude the surrounding ambient medium and in the under water medium, the sealing means may take the form of an O-ring. Further, to prevent contamination of the protuberances when not in use, a waterproof gel, preferably electrically conducting, may be placed within the cavities.

BRIEF DESCRIPTION OF THE DRAWINGS

In the accompanying drawings, which are not to scale.

DESCRIPTION OF THE PREFERRED EMBODIMENT

Figure 1:
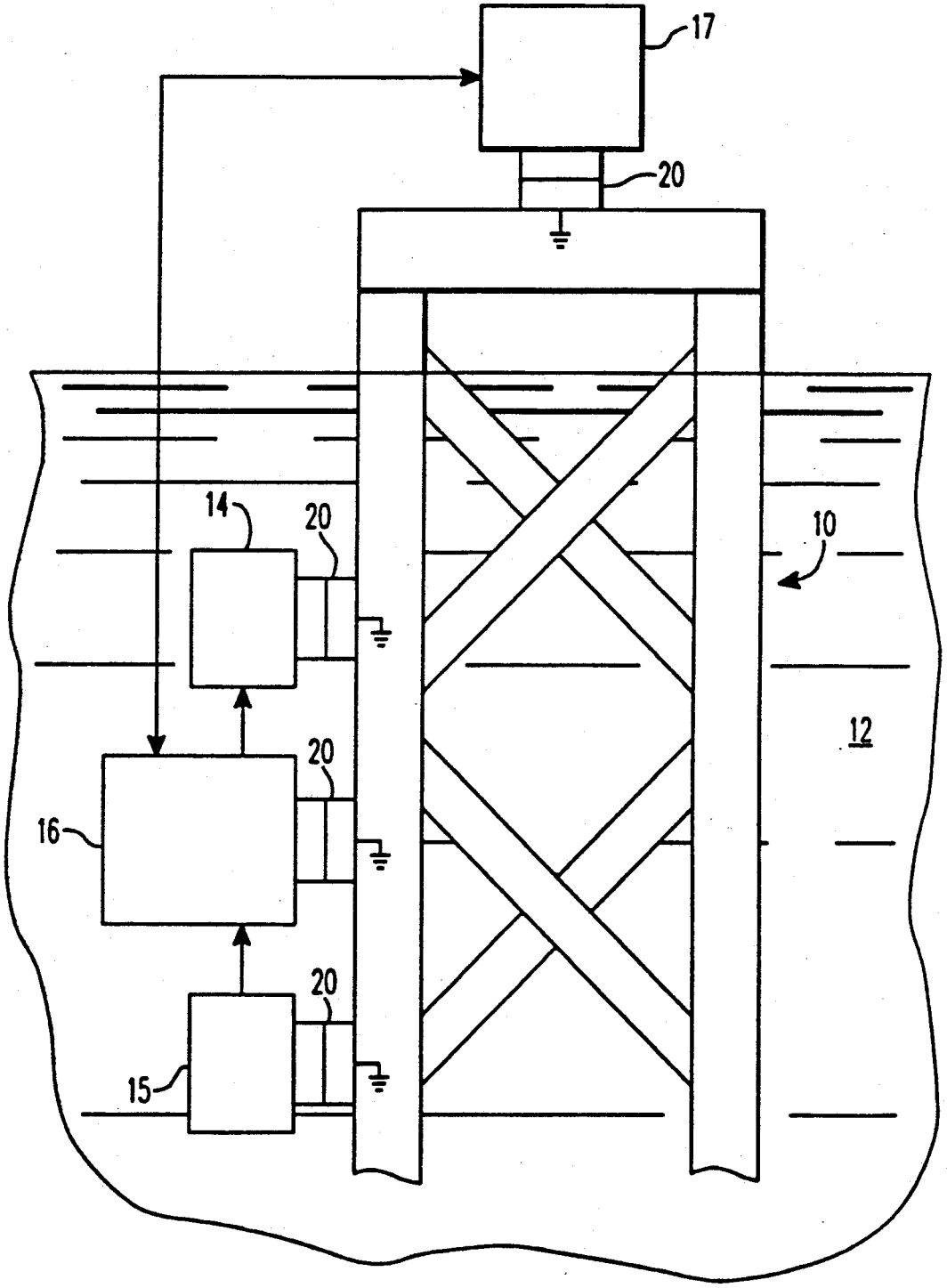
FIG. 1 illustrates a typical environment in which the low impedance connector apparatus of the present invention may be utilized.

Referring now to FIG. 1, there is illustrated, by way of example, an environment in which the present invention may be utilized. A metallic support structure 10 extends into a sea water environment 12 and carries electrical equipment such as sensors 14 and 15 in electrical communication with electronic circuitry 16. The electronic circuitry 16 itself is in electrical communication with a control unit 17 which may be located on the support structure 10 outside of the water environment.

The metallic support structure 10 serves as a common system electrical ground for all the modules of the electrical equipment and to this end each module 15 to 17 includes an electrical ground device 20 in accordance with the present invention.

Figure 2A:
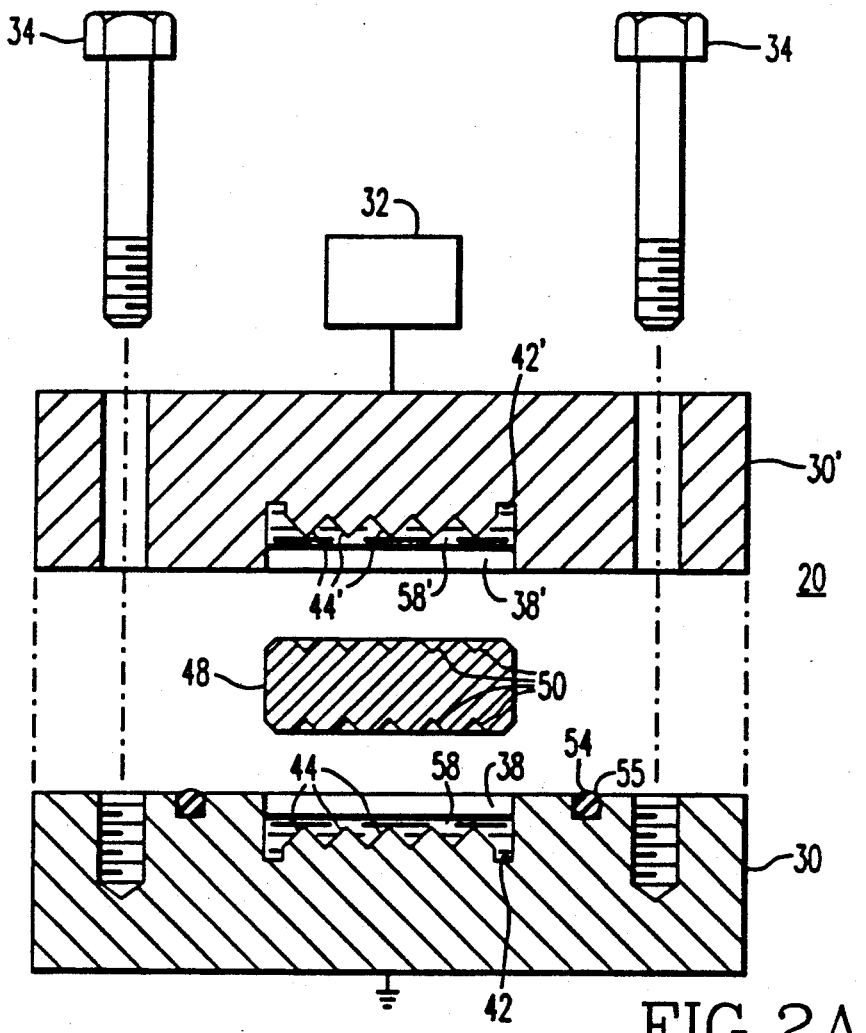
FIG. 2A is an exploded view and FIG. 2B an assembled view, in cross-section, in one embodiment of the present invention.
Figure 2B:
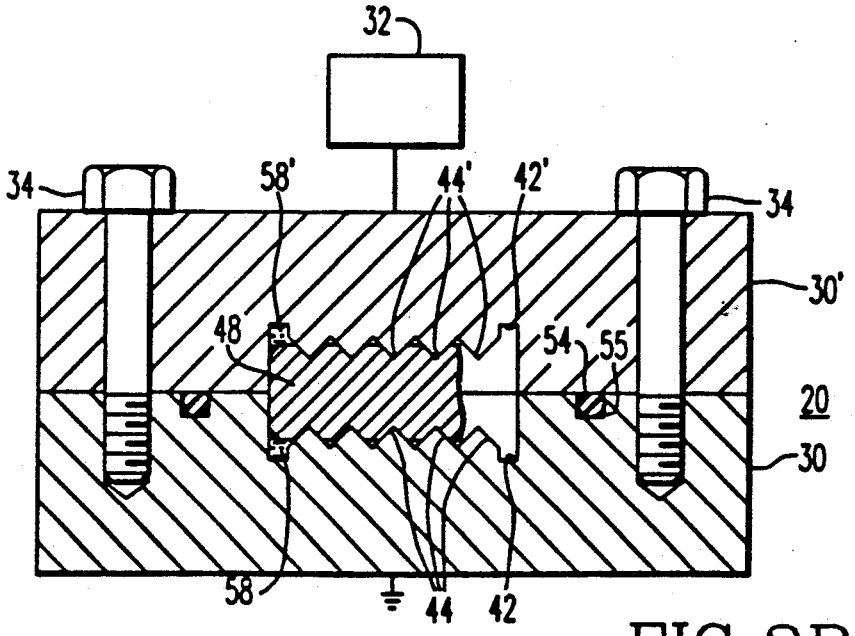

As illustrated in FIG. 2A and 2B, the low impedance connector which functions as an electrical grounding device 20 includes first and second electrically conducting members 30 and 30' with member 30 being part of a system ground and member 30' being connected to electrical apparatus 32 which must be electrically grounded to the system ground.

Clamping means such as bolts 34 may be used to secure the two members 30 and 30' into intimate contact, as illustrated in FIG. 2B. Disconnection may be simply accomplished with the removal of the bolts 34.

Each of the members 30 and 30' includes a respective cavity 38 and 38' which faces the cavity of the other member when they are clamped together thereby forming a hollow chamber 40 (FIG. 2B). Each cavity has a floor surface portion 42 and 42' which includes at least one protuberance or projection. In the embodiment of FIGS. 2A and 2B, a plurality of such protuberances or projections 44 and 44' are illustrated.

The assembly further includes a grounding member in the form of a disk 48 which is situated within the hollow chamber 40 and is of a relatively soft metal such that when the members 30 and 30' are mated together, projections 44 and 44' will penetrate into the disk 48. By way of example, members 30 and 30' may be of metal such as aluminum, stainless steel or titanium and disk 48 may be of a relatively softer metal such as gold, beryllium copper or soft copper. Depending upon the clamping force, the disk 48 may be previously provided with depressions 50 which match the shape and spacing of projections 44 and 44'.

Metals such as titanium oxidizes quickly and the presence of an oxide coating on the projections 44, 44' would objectionally increase the contact resistance. Accordingly, it is desirable to plate the cavities 38, 38' and projections 44, 44' with gold by well-known plating techniques. Gold is the metal of choice for connectors since it is ductile, exhibits little oxidation, and is a good electrical conductor. For these reasons, the disk 48 may also be gold-plated.

Figure 3:
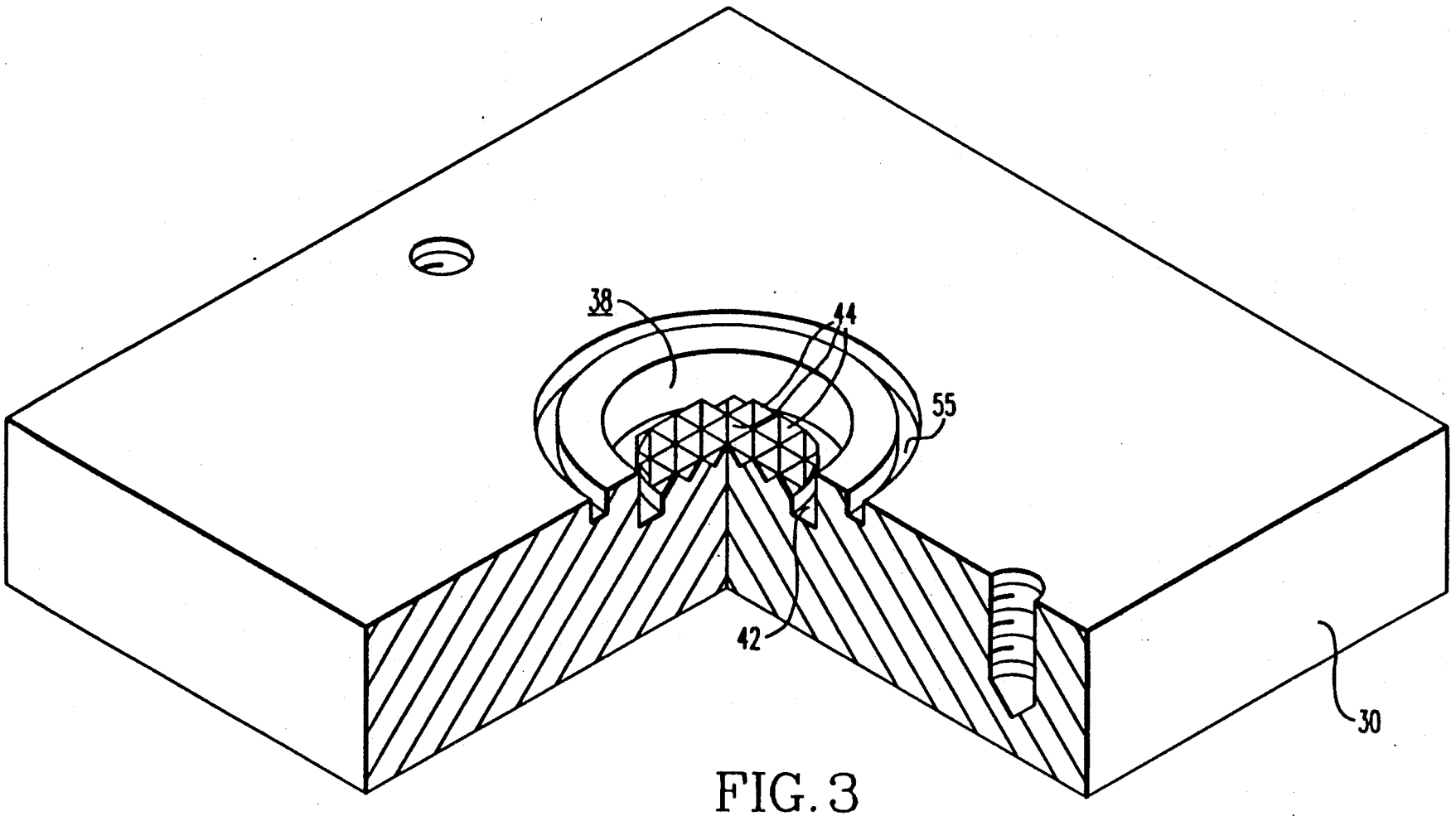
FIG. 3 is a perspective view of one of the components of the connector, with a portion broken away.

Means are provided for sealing the grounding arrangement from the ambient medium particularly for underwater use. Such sealing means in the embodiment illustrated, includes an O-ring seal effected by means of an O-ring 54 which fits in a groove 55 surrounding the chamber 40, as best seen in the cutaway view of FIG. 3. This Figure also shows the projections 44 which may be machined as serrations, and preferably in two directions forming a plurality of pyramidal, sharp projections.

When in use, particularly in the underwater environment, it may be desirable to place a waterproof gel 58 and 58', preferably electrically conducting, within the respective cavities 38 and 38' to exclude the water medium and to prevent any oxidation of the surfaces of projections 44.

Figure 4:
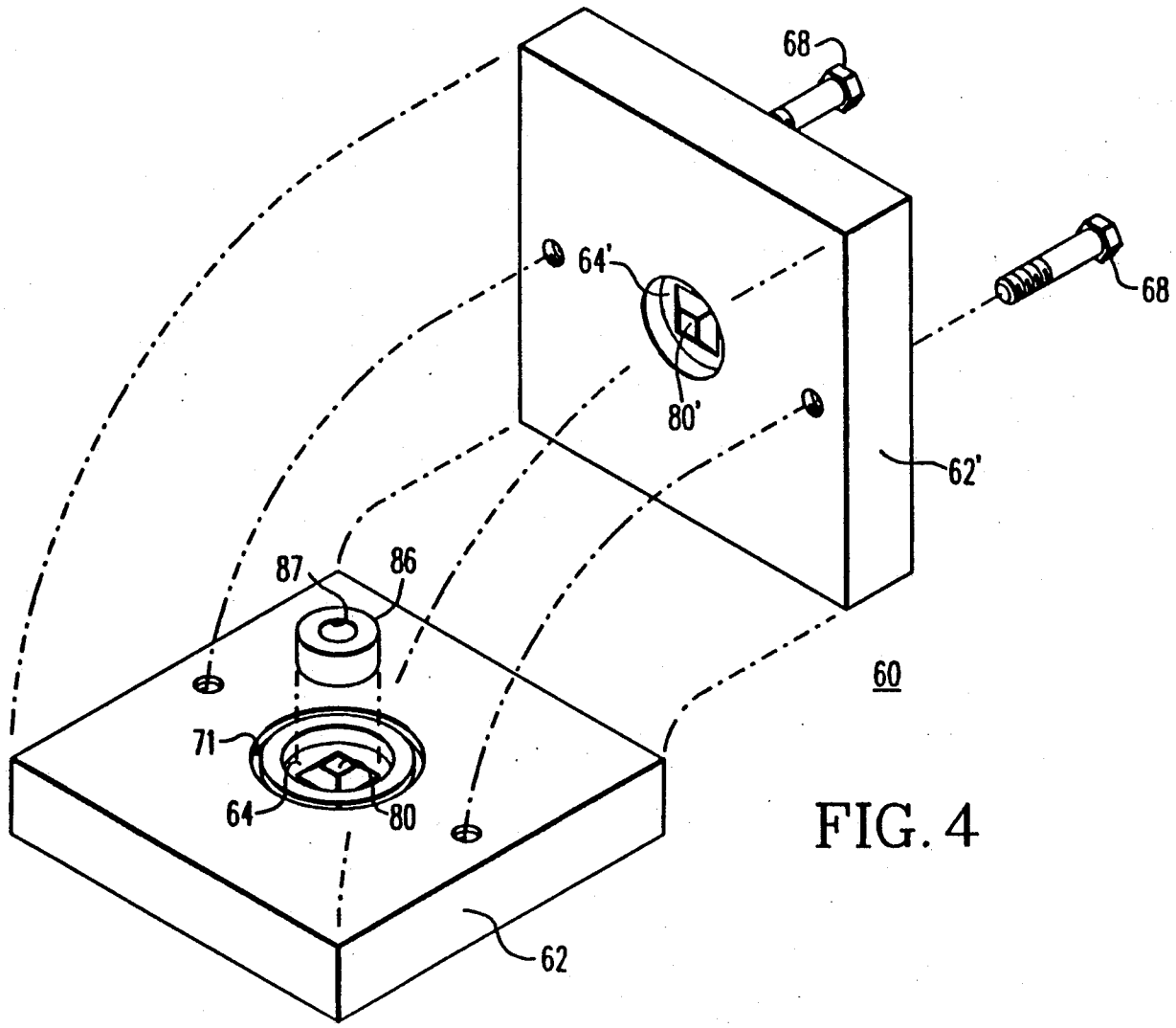
FIG. 4 . is a perspective exploded view of another embodiment of the present invention.
Figure 5:
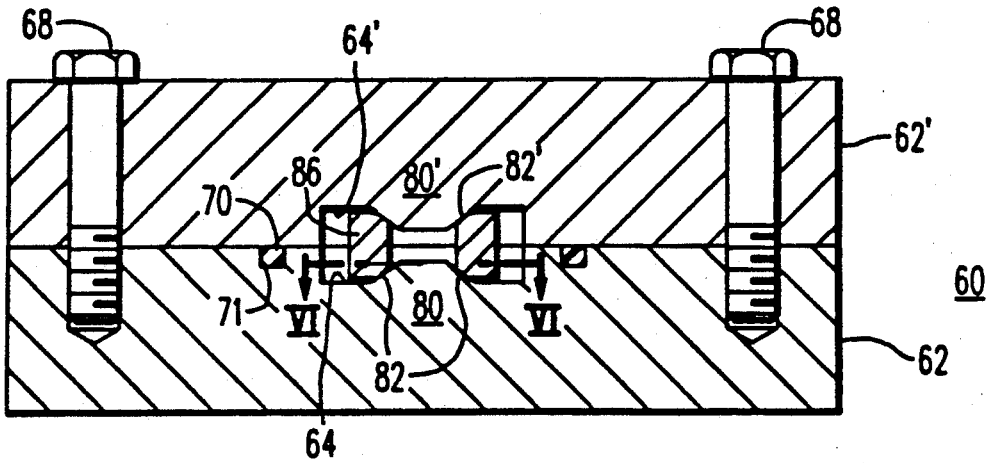
FIG. 5 is a cross-sectional view of an assembled connector as illustrated in FIG. 4.

In the embodiment illustrated in FIG. 4, the electrical grounding device 60 includes first and second opposed electrically conducting members 62 and 62', each having a respective cavity 64 and 64' which face one another to form a hollow chamber 66 when the members are mated and held in place by means of bolt 68, as illustrated in FIG. 5. When in a mated condition, the surrounding ambient medium may be excluded by a sealing means such as O-ring 70 disposed in groove 71.

In this embodiment, each cavity includes a single projection 80, 80', each in the form of a truncated prism, thereby defining a plurality of sharp edge portions 82, 82'.

Figure 6:
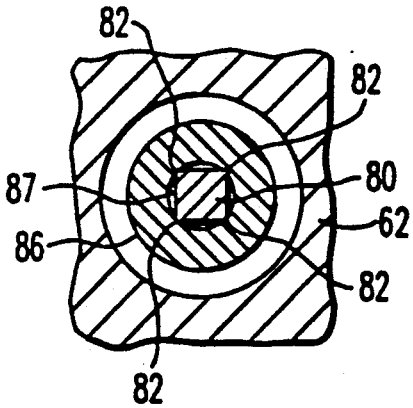
FIG. 6 is a view along the line VI—VI of FIG. 5.

A ground member in the form of disk 86 is provided and includes a central aperture 87 with the aperture 87 and projection 80 being of such size and shape such that when the apertured disk 86 is placed over a projection and the members 62 and 62' clamped together, the sharp edge portions 82 and 82' of projections 80 and 80' will dig into the central wall surface of the apertured disk 86, as seen in FIGS. 5 and 6. This action results in intimate electrical contact between the members 62 and 62', with at least one of which is connected to electrical apparatus and the other of which may be electrically connected to a system ground.

With the present invention therefore, each time a ground connection is to be broken and thereafter reestablished, the bolts may be removed, thereby separating the two members and the connection thereafter established utilizing a new disk with each reassembly of the apparatus. When the units are brought together, the harder material of the members digs into the softer copper disk to obtain contact of bare metal on metal without the presence of any oxides which may increase contact resistance, thereby providing for a very low impedance connection.

We claim:

1. Low impedance electrical connection apparatus comprising:

a) first and second electrically conducting members, at least one of which is for electrical connection to electrical apparatus;

b) clamping means for releasably maintaining said members in intimate contact when in use;

c) each said member including a cavity which faces the cavity of the other member when said members are clamped together thereby forming a hollow chamber;

d) each said cavity including at least one protuberance which projects into said chamber;

e) an electrically conductive grounding disk for placement within said chamber and being of a softer material than said members and protuberances;

f) said grounding disk and said cavity being constructed and arranged that when said grounding disk is inserted into said chamber and said members are clamped together said protuberances will dig into said grounding disk to make intimate electrical contact with and between said members.

2. Apparatus according to claim 1 wherein:

a) each said cavity includes a plurality of said protuberances.

3. Apparatus according to claim 1 wherein:

a) each said cavity includes a single protuberance, each said protuberance having multiple edge portions;

b) said disk includes a central aperture of a size such that when said members are clamped together said protuberances project into said central aperture, and said edge portions dig into said disk.

4. Apparatus according to claim 1 which includes:

a) sealing means surrounding said chamber for excluding the surrounding ambient medium.

5. Apparatus according to claim 1 wherein:

a) said grounding disk is of a relatively soft metal of the group including gold, beryllium copper and copper.

6. Apparatus according to claim 5 wherein:

a) said members are of a relatively hard metal of the group including aluminum, stainless steel and titanium.

7. Underwater electrical grounding apparatus comprising:

a) first and second electrically conducting members, at least one of which carries electrical equipment to be grounded;

b) clamping means for releasably maintaining said members in intimate contact when in the underwater environment;

c) each said member including a cavity which faces the cavity of the other member when said members are clamped together thereby forming a hollow chamber;

d) each said cavity having a floor surface portion which includes a plurality of projections;

e) a grounding disk for placement within said chamber and being of such size and material that when said members are mated together said projections will penetrate into said disk; and f) an O-ring seal surrounding said chamber for excluding the surrounding water medium.

8. Apparatus according to claim 7 wherein:

said grounding disk is in the form of a relatively short circular cylinder.

9. Apparatus according to claim 7 wherein:

a) said floor surface portions are serrated.

10. Apparatus according to claim 8 wherein:

a) said serrations are in two directions.

11. Apparatus according to claim 7 wherein:

a) said grounding disk is of a relatively soft metal of the group including gold, beryllium copper and copper.

12. Apparatus according to claim 7 wherein:

a) said members are of a relatively hard metal of the group including aluminum, stainless steel and titanium.

13. Apparatus according to claim 7 which includes:

a) a waterproof gel disposed within said cavities such that when said members are mated together said projections will penetrate through said gel and into said disk.

* * * * *